US005233845A

United States Patent [19]

D'Andrade

[11] Patent Number: 5,233,845

[45] Date of Patent: Aug. 10, 1993

[54] THREE DIMENSIONAL, DETAILED, SCULPTURED JEWELRY

[76] Inventor: Bruce M. D'Andrade, 3 Ten Eyck Rd., Whitehouse Station, N.J. 08889

[21] Appl. No.: 633,414

[22] Filed: Dec. 21, 1990

Related U.S. Application Data

[63] Continuation-in-part of Ser. No. 496,648, Mar. 21, 1990, abandoned.

[51] Int. Cl.[5] ..... A44C 25/00

[52] U.S. Cl. ..... 63/2; 446/385; 446/901

[58] Field of Search ..... 63/2, DIG. 1, DIG. 3; 446/901, 385

[56] References Cited

U.S. PATENT DOCUMENTS 2,975,538 3/1961 Murfin .
3,390,482 7/1968 Holtviogt .
4,220,016 9/1980 Frenger .
4,280,695 7/1981 Stenehjem et al. .
4,419,395 12/1983 Sugimoto .
4,419,396 12/1983 Sugimoto .
4,581,008 4/1986 House .
4,744,574 5/1988 Gadoua .
4,830,690 5/1989 Cooper .

*Primary Examiner*—James R. Brittain
*Attorney, Agent, or Firm*—Kenneth P. Glynn

[57] ABSTRACT

A decorative, detailed three-dimensional, sculptured jewelry is described, which is worn either directly on a person's body, clothing, or otherwise via an adhesive layer. The jewelry includes a sculptured three-dimensional predetermined ornamental design on its front side having a substantially flat surface on its back. The design has peaks and impressions with varying elevations to create true, detailed sculptured results. There is an adhesive applied to the flat surface of the ornamental design. The adhesive is protected before its use by a removable, peelable non-adhesive layer that attaches to the back of the ornamental design over the applied adhesive. The ornamental design is created from non-conductive, plastic material. The ornamental design is attached, to the area of the user's preference, by removing the peelable protective layer from the adhesive coating on the flat side of the ornament and pressing the adhesive against the preferred surface.

10 Claims, 1 Drawing Sheet

THREE DIMENSIONAL, DETAILED, SCULPTURED JEWELRY

REFERENCES TO RELATED CASES

This application is a continuation in part of U.S. patent application Ser. No. 07/496,648, entitled "Three Dimensional Jewelry" and filed on Mar. 21, 1990 by Bruce M. D'Andrade, abandoned.

BACKGROUND OF THE INVENTION

1. Field of the Invention

The present invention is directed to decorative jewelry which is three dimensional, detailed, sculptured jewelry. It involves jewelry in the form of detailed sculpturing with non-conductive words with adhesive attachments which may be worn either on clothing or directly on the skin, or on any other desired surface.

2. Prior Art Statement

Decorative three dimensional sculptured jewelry has been in existence for centuries and has been created in countless shapes and forms. Just as old and boundless are the means by which such jewelry has been adapted and worn. Thus, in general, prior art on this topic describes the formation of different types of decorative jewelry and the corresponding implements for the placement of such jewelry.

Most prior art, in regard to the formation of decorative jewelry, calls for the use of precious metals, gems or similarly dense materials in its creation. The weight and cost of these materials create size limitations to the formation of the jewelry. Although the technology of lightweight plastic moldings and blown plastic foam have been applied to many applications, their use in forming decorative jewelry has been limited.

The typical applications of lightweight plastic moldings and blown plastic foam is exemplified in U.S. Pat. No. 4,280,695 to Jerome C. Stenehjem, to Stephen C. Jacobsen; U.S. Pat. No. 3,390,482 to J. H. Holtvoight, which show applications through free-standing forms that have mechanical or novelty applications.

Prior art that relates to the application of decorative jewelry to a person, usually depicts a pin, clasp or similar mechanical method of attachment. Those methods of attachments limit the application of jewelry to areas of a person or a persons clothes that accommodate the pin or the clasp. These attachment methods cause damage to the surface on which they are worn and significantly add to the cost and manufacturability of the jewelry. However, some prior art does show the attachment of jewelry through adhesives, as in the present invention, the distinctions from which are set forth below.

The prior art which pertains to adhesively attached jewelry is exemplified by the following:

U.S. Pat. No. 2,975,538 to Murfin describes an emblem and means for adhering it to flat, convex or concave surfaces. The emblem includes an adhesive pad but the adhesive is not entered to be applied to human skin or clothing and makes a seal intending to be permanent.

U.S. Pat. No. 4,581,088 to Robert E. House sets forth a process for creating shaped imitation jewels to be adhered to a persons fingernails. The process or means by which imitation jewels is to be adhered to a person is not addressed.

U.S. Pat. No. 4,220,016 to Rita K. Frenger shows a process for producing jewelry which is color sensitive to temperature. The temperature sensitive jewelry must be adhered directly to the skin to be functional, thus an adhesive strip is used. The adhesive strip described is created to be resilient, flexible and elastic and attaches to a flexible base of the jewelry so that the adhesive surface will form with the contours of the skin to assure adequate thermoconductivity.

U.S. Pat. No. 4,830,690 to Cooper describes a process by which adhesive is used to color an art and craft object. The adhesive is not used to adhere jewelry or any other similar personal item.

U.S. Pat. No. 4,419,396 to Sugimoto describes three dimensional perfumed seals which may be worn as brooches and pendants. These products are crudely three dimensional at best and lack any detail and sculpturing. In fact, the details are printed on the product of Sugimoto and would not necessarily be distinguishable merely by the contours. These contours are simplistic and are made with covered vinyl which is welded onto the base and pulls down on the foam to form undulations. The undulations are not capable of abrupt changes in direction, e.g. a sharp chin or squared cap. These are all mathematically arcuated and do not have any indentations or impressions which have only partial depths to create actual sculpturing. The Sugimoto products are not capable of partial indentations or impressions due to inherent limitations of the methods of formation.

Thus, the prior art does teach that jewelry may be made from lightweight plastic moldings and blown plastic foam which are made to give realistic three dimensional detailed sculpturing having partial and full impressions therein. Thus, the prior art does not show the use of plastic foams, moldings and adhesives to create the detailed decorative three-dimensional sculptured jewelry of the present invention.

BRIEF SUMMARY OF THE INVENTION

The present invention is directed to decorative three-dimensional, detailed, sculptured jewelry which is formed of foam plastic and has contours and impressions of varying depth. It is worn either directly on a person's body, clothing, or otherwise via an adhesive layer. The jewelry includes a detailed, sculptured three dimensional predetermined ornamental creation on its front side with varying thicknesses and areas of impressions of varying thicknesses, and having a substantially flat surface on its back. There is an adhesive applied to the flat surface of the ornamental creation. The adhesive is protected before its use by a removable, peelable non-adhesive layer that attaches to the back of the jewelry over the applied adhesive.

BRIEF DESCRIPTION OF THE DRAWINGS

The invention will be more fully understood by referring to the following detailed specification, the above specification, and the claims set forth herein, when taken in connection with the drawings attached hereto, wherein:

DETAILED DESCRIPTION OF THE PRESENT INVENTION

Figure 1:
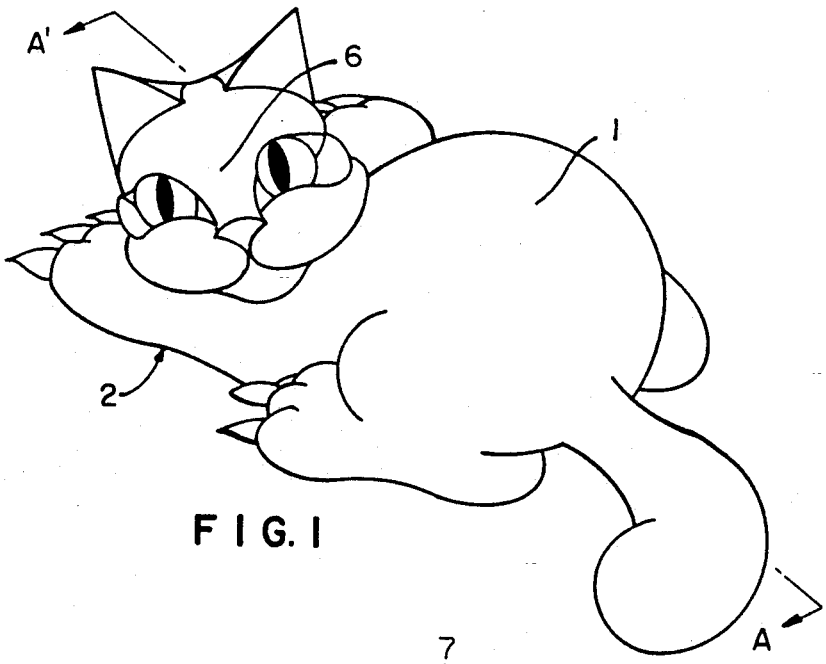
FIG. 1 illustrates a front oblique view of the present invention decorative three dimensional jewelry.

The present invention is, as mentioned, directed towards detailed, decorative, three dimensional, sculptured jewelry which may be worn anywhere on the body, clothing or otherwise. The term "three dimensional sculptured" jewelry, as used herein, means having variable thickness on at least its front surface so as to create selected elevations, i.e., peaks and impressions which may include abrupt directional changes, in a predetermined arrangement so as to create a desired or predetermined design and appearance. Thus, the term refers to the physical characteristics of the product.

Historically, decorative jewelry has been created from precious metals or equally as dense materials. The weight of these materials has created size and design limitations to the formation of jewelry, and has limited the areas on which such jewelry could be comfortably worn. Similarly, traditional jewelry requires a chain, pin, clasp or other mechanical device that limits the application of decorative jewelry to a particular area of the body, clothes or otherwise.

Decorative, three dimensional jewelry has prehistoric origins. However, it has only been in recent years that modern technology and materials have affected societies attitudes about what jewelry can be and how it can be applied. The decorative three dimensional jewelry of the present invention eliminates the limitations of traditional jewelry and offers substantial advantages. The present invention jewelry is lightweight, formed from plastic material e.g. semi-flexible molded plastic, and may be created, for example, by partially blown plastic foam. Alternatively, polymer coated molds with foamed insitu centers may be used. Other processes similar to these may also be employed. The lightweight construction of the present invention jewelry may be molded into any predetermined three-dimensional shape and may take on any sculptured configuration imagined, with a topography having peaks or high points at varying elevations and having impressions or low points at varying elevations. Additionally, this lightweight plastic material is nonconductive and noncorrosive eliminating the traditional jewelry problems of tarnishing, discolorization of the skin, expense of precious metals, related theft concerns, etc.

The back side of the present invention jewelry will be formed to be substantially flat, and will be coated with an adhesive. This formation will allow the flat surface of the jewelry to be securely adhered to any area of a persons skin, clothing or otherwise. The use of the adhesive, in place of the tradition jewelry fastening devices such as chains, pins and clasps, removes the limitations of where and how the jewelry can be applied. Similarly the adhesive removes the added costs of other mechanical fasteners and adds to jewelry's manufacturability.

To ensure ease of use for the adhesive jewelry fastener, a peelable, removable protective layer is placed over the adhesive on the flat side of the jewelry. This layer prevents the jewelry from adhering to other surfaces until the user so desires. When the jewelry is to be worn, the protective layer is pealed off the adhesive and discarded. The jewelry is then placed against the surface, to which it is to be applied, and pressed firmly. The adhesive will adhere the jewelry to any part of the body, clothing or otherwise and will remain in such a location until removed. Optionally, multiple backings may be supplied to the user so that repeated storage, use and reuse is achieved. When one backing loses its adhesiveness, a new, e.g. double backed adhesive tape, cut to the contour of the device, will be used to replace it.

Referring now to FIG. 1, there is shown an oblique front view of one preferred embodiment of the detailed decorative three dimensional sculptured jewelry. The embodiment consists of a decorative three dimensional sculptured ornamental design 1 and a flat back surface 2. It should be noted that both the peaks and the impressions thereon having varying elevations above the back surface 2. This is vividly shown in FIG. 2.

Figure 2:
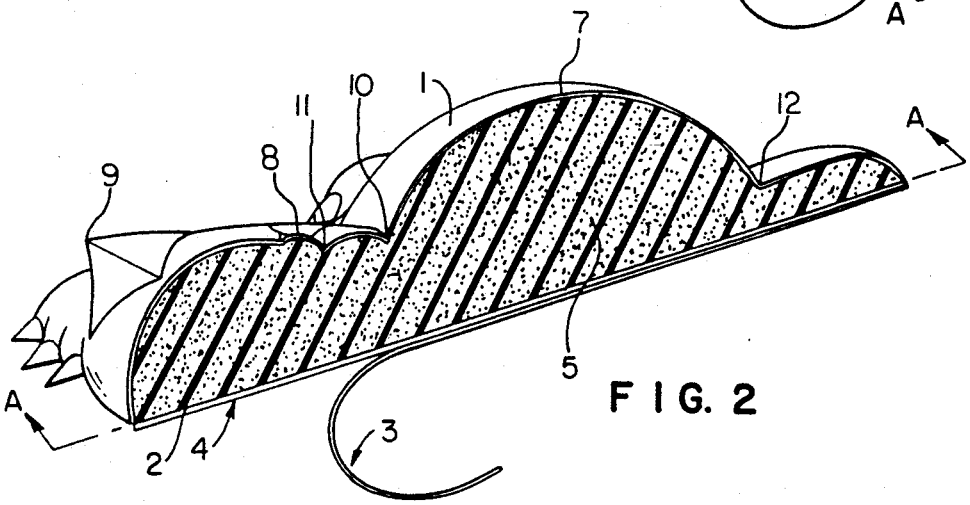
FIG. 2 illustrates a rear oblique view of the present invention.

FIG. 2 shows an oblique view of a cross-sectional cut of the decorative three dimensional jewelry 1, cut along cross-sectional line A—A. The oblique view from FIG. 2 shows cross-sections of the laminations and the semi-flexible molded blown foam material 5, which creates an embodiment of detailed decorative three dimensional sculptured ornamental jewelry 1. FIG. 2 shows a cross-section of the flat back surface 2 of the decorative three dimensional jewelry 1, the cross-section of the adhesive layer 4 that coats the flat back surface 2, and the cross-section of the protective, peelable, removable layer 3, that protects the adhesive layer 4 and has the same dimensions of the flat back surface 2. FIG. 2 shows the protective, peelable, removable layer 3 in the partially removed position, exposing half of adhesive layer 4. In addition, FIG. 2 illustrates the sculptured front peaks typified by peaks 7, 8, and 9 and impressions typified by impressions 10, 11, and 12. These peaks and impressions having varying elevations relative to the back surface 2, creating true sculptured detail.

Figure 3:
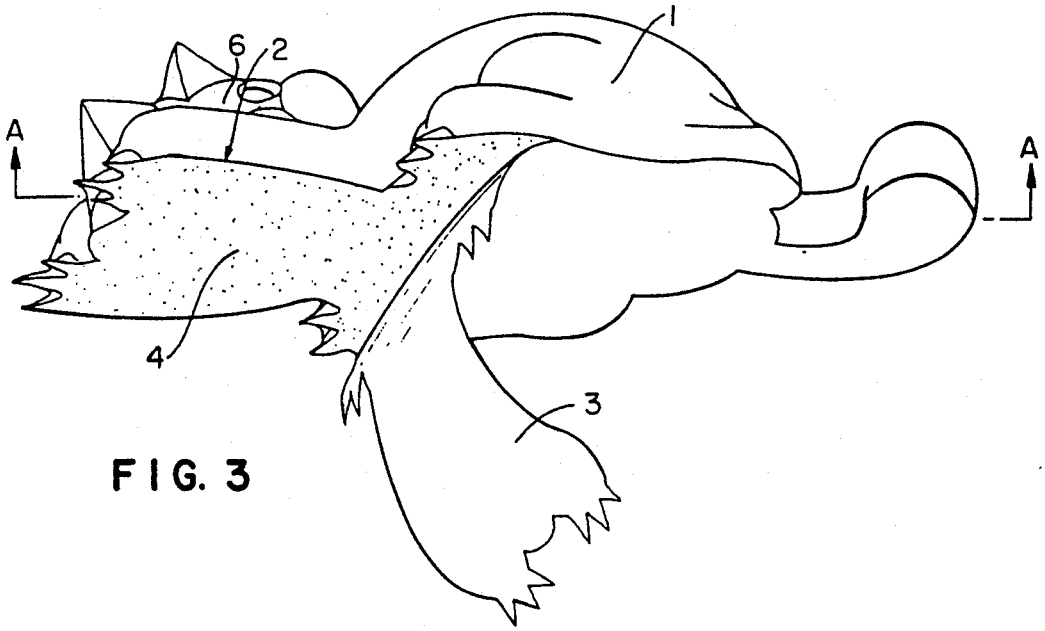
FIG. 3 shows an oblique cross-sectional view of the present invention taken along line A—A.

The view of the partially removed protective, peelable, removable layer 3, is best shown in FIG. 3. FIG. 3 shows an oblique view of the flat back surface 2 of the decorative three dimensional sculptured ornamental jewelry 1. FIG. 3 also shows the protective, peelable, removable layer 3 in its partially removed state, exposing the adhesive layer 4 that covers the flat back surface 2.

To adhere the decorative three dimensional sculptured ornamental jewelry 1 to any part of a persons body, clothes, or otherwise, the protective, peelable, removable layer 3 is removed, exposing the adhesive layer 4. The flat back surface 2 of the decorative three dimensional sculptured ornamental jewelry 1 is then pressed against the surface of the desired location. The adhesive layer 4 then temporarily adheres the semi-flexible molded blown foam material 5 of the decorative three dimensional sculptured ornamental jewelry 1 to any surface on which it is applied.

As mentioned, the plastic sculptured jewelry of the present invention has a substantially flat back and a three dimensionally sculptured front. It may be cast or molded and may be solid plastic or blown. Preferably, it is at least partially blown for some flexibility and economy of materials. It may be made of two distinct materials and may be filled. The choice of particular plastics, etc. is within the skill of the artisan. Likewise, colors, dyes, paints and finishes may be any conventionally available in the plastics industry. However, regardless of whether the present invention jewelry is formed by casting or molding with a single component, a layered structure or an integral skin foam, the cavity is a casting or sculpturing process must be such that it will create both peaks and impressions of varying elevations to yield true, detailed sculptured products.

Obviously, numerous configurations, colors and materials can be used in varied forms of the present invention. It is therefore understood that within the scope of the appended claims, the invention may be practiced otherwise than as specifically described herein.

What is claimed is:

1. Decorative, detailed, three dimensional, sculptured jewelry which may be worn on the skin, clothing, or otherwise of a wearer, which comprises:

(a) a clasp-free, detailed, sculptured, three dimensional member being constructed of non-conductive material and having a front and a back , said member having a three dimensional, predetermined ornamental design on its front and having a substantially flat surface on its back, said design on its front having peaks and impressions, said peaks having varying elevations relative to said back and said impressions having varying elevations relative to said back; and, (b) an adhesive material applied to at least a portion of said back in an amount sufficient to permit adherence thereof to a desired surface.

2. The jewelry of claim 1 wherein said member is a molded plastic member.

3. The jewelry of claim 2 wherein further comprises:

(c) a removable, peelable non-adhesive layer attached to the back of said member and over said adhesive for easy removal to expose the adhesive for a user.

4. The jewelry of claim 3 wherein said member is a semi-flexible molded plastic material.

5. The jewelry of claim 4 wherein said member is at least partially blown plastic foam.

6. The jewelry of claim 5 wherein said partially blown plastic is an integral skin partially blown plastic foam.

7. The jewelry of claim 1 wherein said member is a semi-flexible molded plastic material.

8. The jewelry of claim 7 wherein said member is at least partially blown plastic foam.

9. The jewelry of claim 8 wherein said partially blown plastic is an integral skin partially blown plastic foam.

10. The jewelry of claim 1 which further comprises:

(c) a removable, peelable non-adhesive layer attached to the back of said member and over said adhesive for easy removal to expose the adhesive for a user.

* * * * *